US010392797B2

(12) United States Patent
Cullen

(10) Patent No.: US 10,392,797 B2
(45) Date of Patent: Aug. 27, 2019

(54) SINGLE LEAF SEPARATING WALL

(71) Applicant: Glenalmond Timber Company Limited, Perth (GB)

(72) Inventor: Douglas Wilson Cullen, Perth (GB)

(73) Assignee: GLENALMOND TIMBER COMPANY LIMITED, Perth (GB)

( * ) Notice: Subject to any disclaimer, the term of this patent is extended or adjusted under 35 U.S.C. 154(b) by 0 days.

(21) Appl. No.: 15/350,069

(22) Filed: Nov. 13, 2016

(65) Prior Publication Data

US 2017/0138041 A1 May 18, 2017

(30) Foreign Application Priority Data

Nov. 18, 2015 (GB) ..... 520356.5

(51) Int. Cl.

| | |
|---|---|
| ***E04B 1/10*** | (2006.01) |
| ***E04B 1/82*** | (2006.01) |
| ***E04B 1/84*** | (2006.01) |
| ***E04B 1/86*** | (2006.01) |
| ***E04B 2/56*** | (2006.01) |
| ***E04B 2/70*** | (2006.01) |

(52) U.S. Cl.

CPC ..... *E04B 1/82* (2013.01); *E04B 1/10* (2013.01); *E04B 1/8409* (2013.01); *E04B 1/86* (2013.01); *E04B 2/562* (2013.01); *E04B 2/70* (2013.01); *E04B 2/707* (2013.01)

(58) Field of Classification Search

CPC . E04B 1/82; E04B 1/8409; E04B 1/86; E04B 1/84; E04B 2/562; E04B 2/70; E04B 2/7412; E04B 2/7457; E04B 2001/7679

See application file for complete search history.

(56) References Cited

U.S. PATENT DOCUMENTS

| | | | | |
|---|---|---|---|---|
| 4,671,032 A * | 6/1987 | Reynolds | E04C 2/386 52/127.11 |
| 5,907,932 A | 6/1999 | LeConte et al. | |
| 6,256,959 B1 * | 7/2001 | Palmersten | E04B 1/86 181/292 |
| 6,397,550 B1 * | 6/2002 | Walker | E04C 3/07 52/481.1 |

(Continued)

FOREIGN PATENT DOCUMENTS

| | | |
|---|---|---|
| CN | 204356941 U | 12/2014 |
| GB | 988279 A | 4/1965 |

(Continued)

OTHER PUBLICATIONS

Definition of "stud" by Merriam Webster dictionary found at: https://www.merriam-webster.com/dictionary/stud.*

(Continued)

*Primary Examiner* — Brian D Mattei

(74) *Attorney, Agent, or Firm* — Law Office of Jesse D. Lambert, LLC

(57) ABSTRACT

A single leaf building component for use in separating walls in timber frame building construction. Two timber frame studs are held together at an edge by at least one acoustic connector. The connector holds the frames at a fixed distance, prevents sound transfer and provides a lifting point. Embodiments of the connector are described with the inclusion of a dampening material and having a timber body.

16 Claims, 8 Drawing Sheets

(56) References Cited

U.S. PATENT DOCUMENTS

| | | | | |
|---|---|---|---|---|
| 8,516,778 | B1 * | 8/2013 | Wilkens | E04C 3/292 52/309.13 |
| 8,820,034 | B1 * | 9/2014 | Watts | E04C 3/16 52/404.1 |
| 2002/0053180 | A1 * | 5/2002 | McGrath | E04B 2/7411 52/481.1 |
| 2002/0066253 | A1 * | 6/2002 | Smith | E04B 1/82 52/837 |
| 2002/0092703 | A1 * | 7/2002 | Gelin | E04B 1/86 181/285 |
| 2003/0226331 | A1 * | 12/2003 | Lindberg | E04C 3/07 52/847 |
| 2006/0042874 | A1 | 3/2006 | Foster et al. | |
| 2007/0246297 | A1 * | 10/2007 | Gerlich | E04B 2/7457 181/294 |
| 2009/0277125 | A1 * | 11/2009 | Smith | E04B 1/84 52/714 |
| 2011/0239573 | A1 * | 10/2011 | Lockhart | E04B 2/7412 52/404.1 |
| 2013/0199110 | A1 * | 8/2013 | Sias | B66C 1/62 52/125.2 |
| 2015/0361659 | A1 * | 12/2015 | Sessler | E04B 2/7457 52/483.1 |
| 2016/0145859 | A1 * | 5/2016 | Yoon | E04C 2/296 52/204.5 |
| 2017/0009442 | A1 * | 1/2017 | Iverson | E04B 1/30 |

FOREIGN PATENT DOCUMENTS

| | | | |
|---|---|---|---|
| GB | 2448765 | A | 10/2008 |
| GB | 2512565 | A | 10/2014 |
| WO | WO01/33007 | A1 | 5/2001 |
| WO | WO2005/024148 | A1 | 3/2005 |

OTHER PUBLICATIONS

United Kingdom Intellectual Property Office, Search report for GB1520356.5, dated May 10, 2017, pp. 1-5.

* cited by examiner

PRIOR ART

SINGLE LEAF SEPARATING WALL

The present invention relates to timber frame building construction and more particularly, though not exclusively, to a single leaf building component for use in separating walls.

Figure 1A:
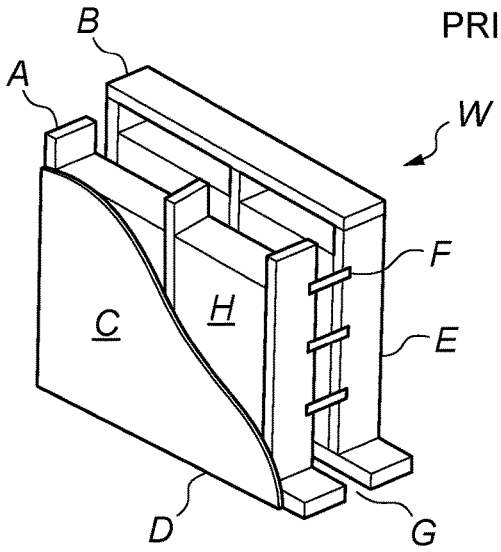
Figure 1B:
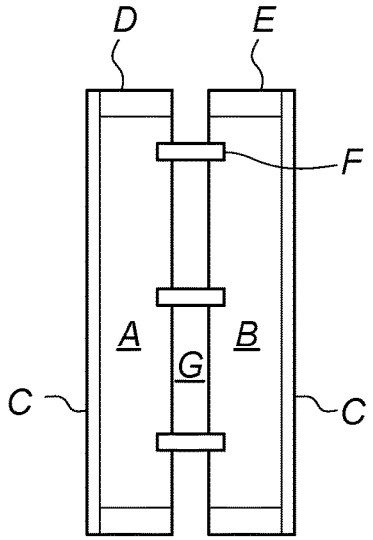
Figure 2A:
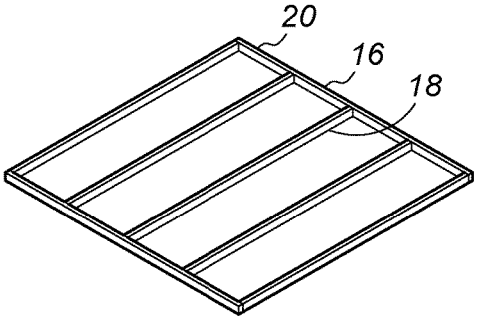
Figure 2B:
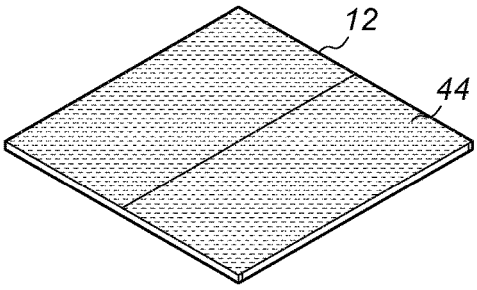
Figure 2C:
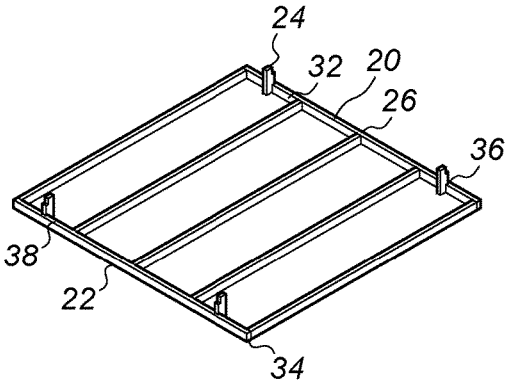
Figure 2D:
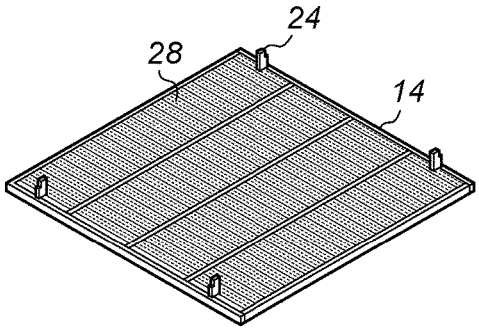
Figure 2E:
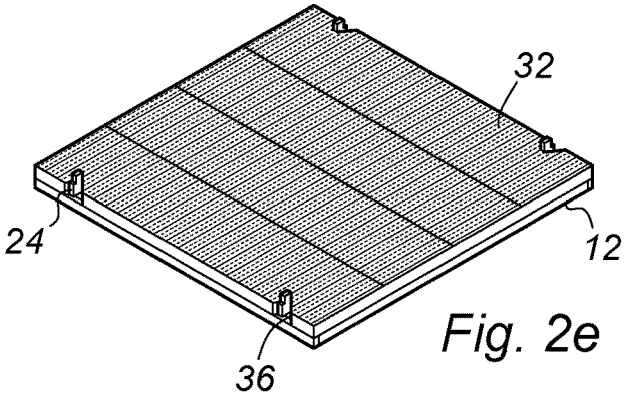
Figure 2F:
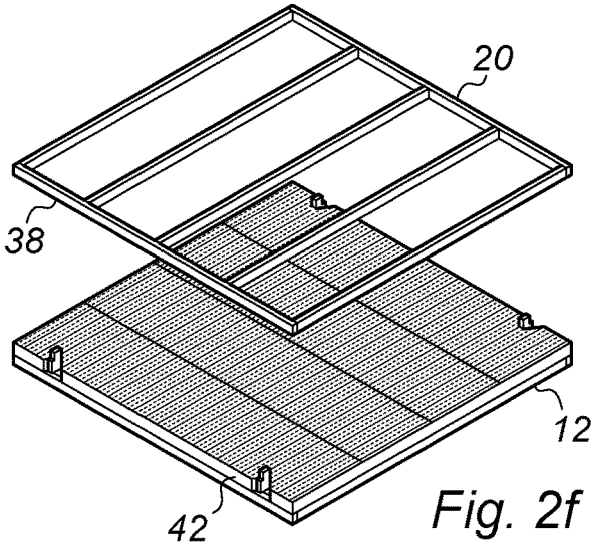
Figure 2G:
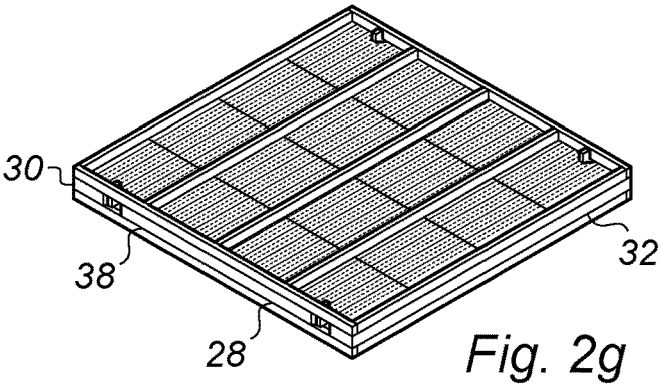
Figure 2H:
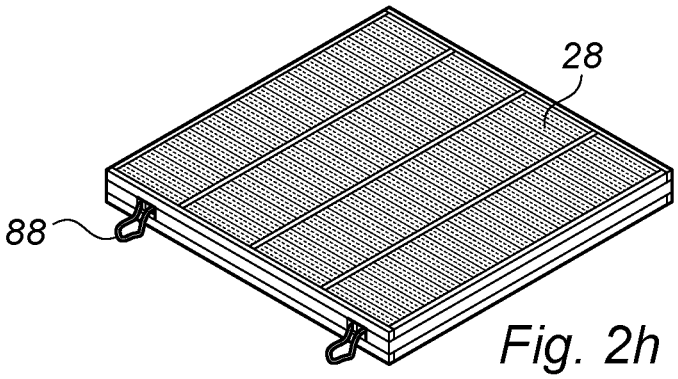
Figure 2I:
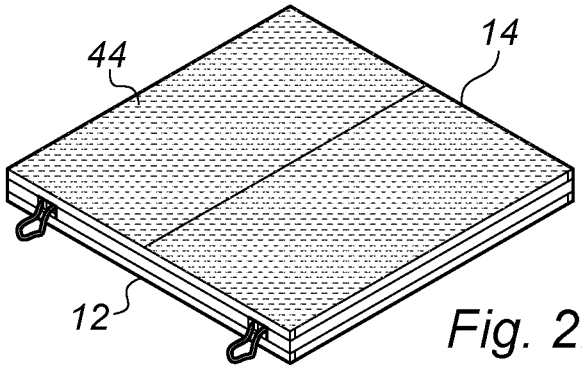
Figure 2J:
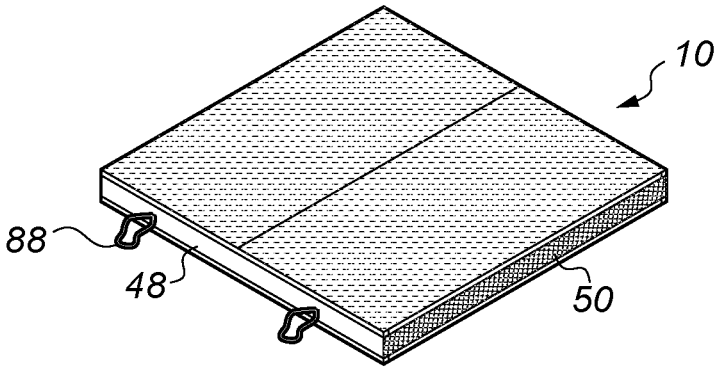
Figure 4A:
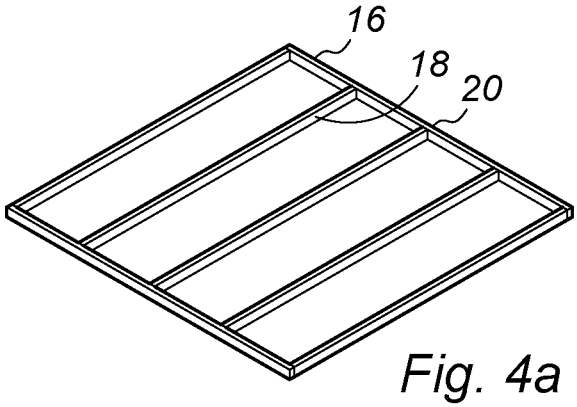
Figure 4B:
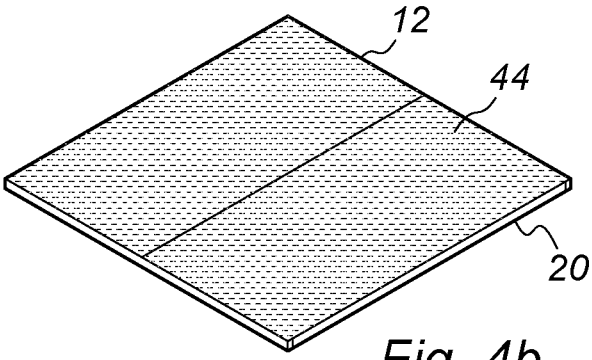
Figure 4C:
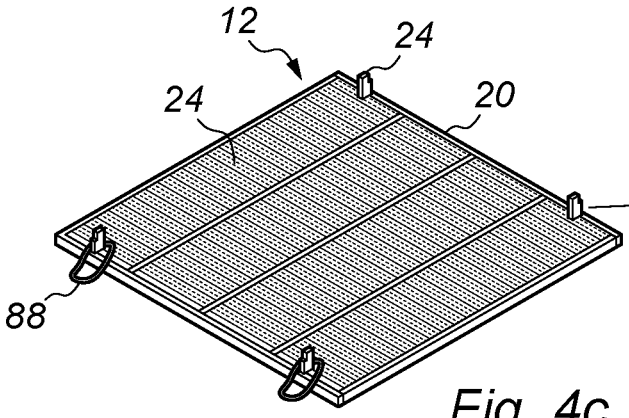

In timber frame building construction, separating walls and floors are required between residential units. A traditional separating wall W is shown in FIGS. 1(*a*) and (*b*). Two timber stud frames A, B are constructed on site at a desired separation. Timber panels C are nailed to the rails of the frames to create a pair of timber frame wall leafs D, E which are located a short distance apart. To aid construction, the leafs D, E are tied together using a number of the metal strips F nailed across the cavity G on the outside edge of the leafs. Insulation H may be placed between the leafs D, E and plasterboard can then be located over the panels C to create the inner walls of the residential unit. Skilled joiners are needed and significant build time is required to construct the separating walls and floors. To speed up construction pre-assembled wall leafs D, E can be brought to the site.

The separation between the leafs D, E must be maintained as an insulator to assist in resisting the passage of sound and vibration through the cavity G. The cavity G will define the acoustic performance of the wall W and it has been found that cavities which are too small or narrow between the opposite leafs leads to significant dips in acoustic and sound insulation performance at low frequencies.

On-site construction of the wall W, either entirely or as a pair of leafs means that this separation cannot be defined and maintained so acoustic performance cannot be guaranteed. The metal strips F also disadvantageously provide a path for sound and vibrations to be transmitted between the leafs D, E. Regulations provide for a minimum number of strips to achieve correct tying of the frames together while attempting to minimise the risk of sound and vibration transfer.

GB 2448765 to Illinois Tool Works Inc. describes a metal strip being a structural tie or party wall strap in the form of a connector for use in the construction industry. The connector is substantially rectangular with fixing points at either end for fastening to walls or the like and includes an acoustic attenuation mechanism to enhance acoustic performance between the walls. The acoustic attenuation mechanism is embodied as folds, apertures and/or openings through the connector which prevent direct passage of sound and vibration waves through the connector, between the walls. While this arrangement assists in limiting the sound transmission through the strips, it does not speed up the construction time, as these strips are located on the leafs or timber stud frames on-site.

It is therefore an object of the present invention to provide a building component for use as a separating wall which is a single piece for ease and speed of construction.

It is a further object of the present invention to provide a building component for use as a separating wall which provides a guaranteed separation between leafs without the use of metal strips.

According to a first aspect of the present invention there is provided a building component for use as a separating wall, the component comprising a first plurality of timber studs arranged as a timber frame for a leaf, a second plurality of timber studs arranged as a timber frame for a leaf, wherein at least one acoustic connector is located between the frames on a first side of the component, the at least one acoustic connector being arranged on an inner edge of a timber stud of the first side of the component.

In this way, a single leaf separating wall is provided having two leafs at a fixed separation. Use of an acoustic connector ensures that sound quality is not compromised across the structure. By locating the connector on an inner edge of a timber stud of the perimeter of the leafs, the building component can be abutted to neighbouring components without creating an air gap in construction and may be stacked more easily for storage. Handling and installation of a single leaf separating wall simplifies and consequently speeds up construction time.

Preferably, there is at least one connector on opposite sides of the component. Preferably also at least one connector is arranged on each side of the connector. Increased numbers of connectors stabilise the building component. In a preferred embodiment there are two connectors arranged on a first edge. In this way, lifting straps can be looped around each connector to lift the component and locate onto a building being constructed.

Preferably each timber frame is sheathed by a board. The board may include acoustic blocking properties to improve the reduction in sound transmission across the component. The panel may be selected from gypsum plasterboard, magnesium oxide wallboard or timber boarding. MGO is favoured as it provides the best fire protection. This incorporation of a board as a panel provides both additional rigidity to the component and removes the requirement for board to be applied on-site to give two separated leafs.

Preferably, one or more parts of the building component are treated with a water repellent. In this way, the component will not be affected by shrinkage. Optionally, the one or more parts of the building component are treated with a fire retardant.

Preferably insulation is located between the studs on each frame. In this way, the building component provides insulation while maintaining a separation between the leafs. Alternatively or additionally, insulation may be located in the separation between the leafs. This increases the thermal insulation to the component and removes the requirement for inserting insulation between separating walls on-site.

Preferably the acoustic connector provides first and second abutting surfaces separated by a desired separation distance. In this way, the timber studs can be located against the connector to provide the desired separation. Preferably the acoustic connector includes a sound attenuation element. Preferably the sound attenuation element is an acoustic isolator. More preferably the sound attenuation element is a dampening material. Preferably the dampening material is a bitumen-based flexible material. More preferably the sound attenuation element is arranged between the timber stud and a body of the connector. Preferably the connector has a timber body. In this way, the component can be substantially constructed from environmentally friendly materials.

According to a second aspect of the present invention there is provided a building connector for a single leaf separating wall, comprising an a substantially rectangular elongate body having first and second opposing ledges on a first surface thereof, the ledges providing a protrusion with a length equal to a desired separation between two leafs of the separating wall and each ledge including a sound attenuation element.

In this way, leafs of a separating wall can be held together without compromising the acoustic or vibration properties of the separating wall.

Preferably the sound attenuation element is an acoustic isolator. More preferably the sound attenuation element is a dampening material. Preferably the dampening material is a bitumen-based flexible material. This provides a flexible material which can be applied to the body of the connector reducing the cost of the connector and time to manufacture.

Preferably the connector has a timber body. In this way, the component can be substantially constructed from environmentally friendly materials.

Preferably, the timber body is treated with a water repellent. In this way, the connector will not be affected by shrinkage. Optionally, the timber body one is treated with a fire retardant.

Figure 3:
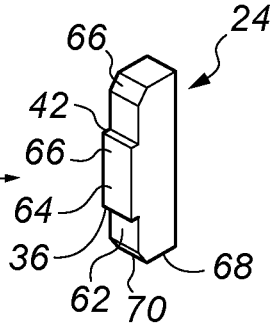
Figure 4D:
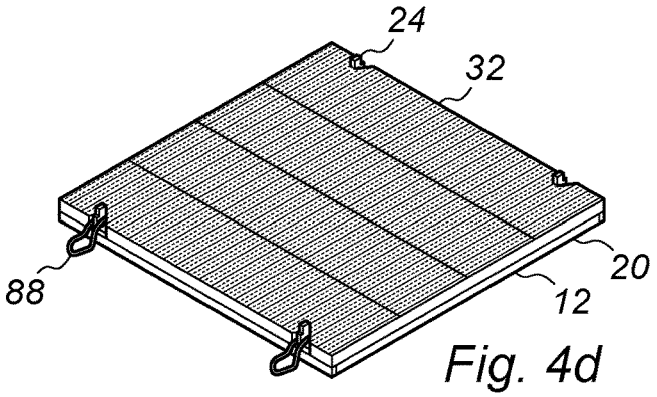
Figure 4E:
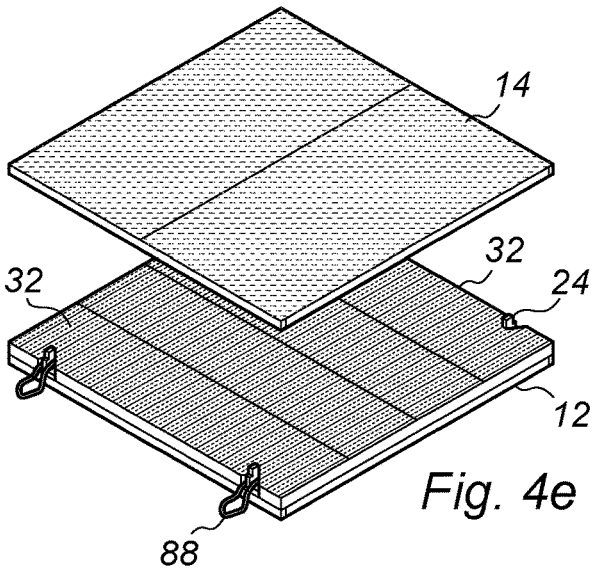
Figure 4F:
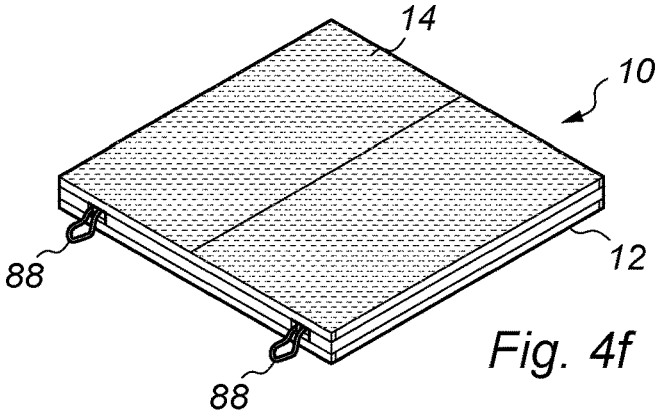
Figures 5A, 5B:
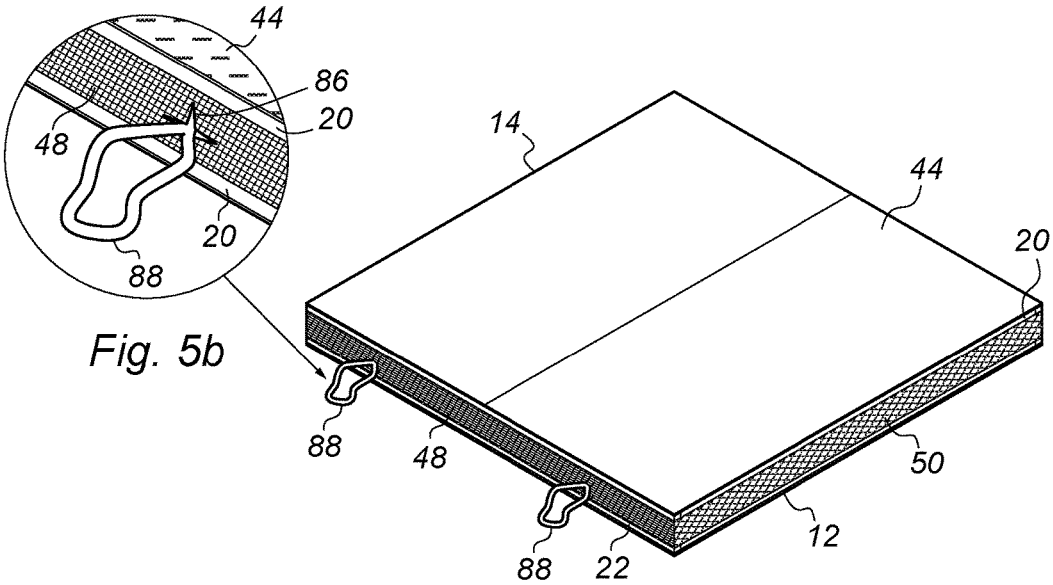
Figure 6:
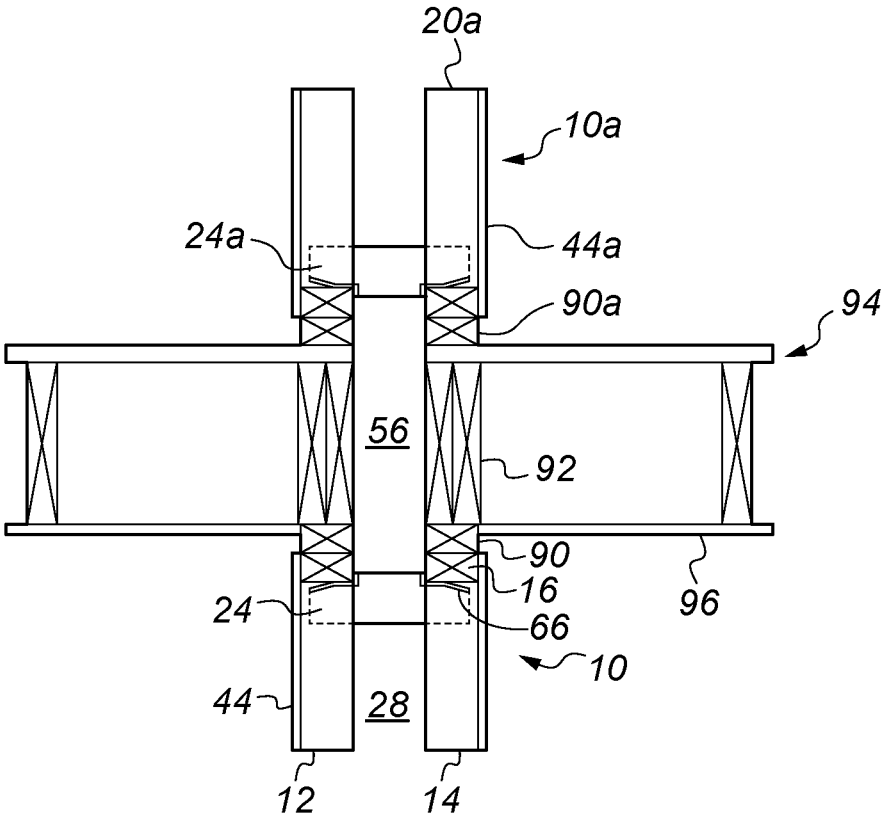

Embodiments of the present invention will now be described by way of example only with reference to the accompanying drawings of which:

FIGS. 1(*a*) and 1(*b*) are plan and cross-sectional views of a prior art separating wall arrangement;

FIGS. 2(*a*) to 2(*j*) are plan views of the construction of a building component for use as a separating wall according to an embodiment of the present invention;

FIGS. 3 is a plan view of a building connector for a single leaf separating wall according to an embodiment of the present invention;

FIGS. 4(*a*) to 4(*f*) are plan views of the construction of a building component for use as a separating wall according to an embodiment of the present invention;

FIGS. 5(*a*) and 5(*b*) are plan views of a building component for use as a separating wall according to an embodiment of the present invention; and FIG. 6 is a cross-sectional view of separating wall arrangement at a floor level including building components according to an embodiment of the present invention.

Referring initially to FIGS. 2(*a*) and 2(*j*) of the drawings there is illustrated a building component, generally indicated by reference numeral 10, according to an embodiment of the present invention. Component 10 is formed from two leafs 12, 14. Each leaf 12, 14 comprises solid timber battens or studs 16 arranged around the perimeter of a rectangle or square. Inner support battens 18 can be used to brace the frame 20 formed by the studs 16. At the top 22 and bottom 26 sides of the frame 20 there are a pair of connectors 24 located on the inside of the frames 20. The building component 10 can be considered as a single leaf separating wall.

Building component 10 also includes magnesium oxide board 44 located across each frame 20 on the leafs 12, 14 to provide an entire building component 10 which can be considered as a single leaf separating wall. Insulation 28, 32 may also be located between the leafs 12, 14 and in the cavity 30 if desired.

The component 10 is manufactured by first constructing a frame 20 of timber studs 16 with parallel aligned bracing battens 18 arranged within, as shown in FIG. 2(*a*). The studs may be 38×75 C16 timber. Panels or boards 44 are used to sheath the frame 20 and provide support to create a leaf 12, 14 as would be known to those skilled in the art (see FIG. 2(*b*)). An acoustic connector 24, as described with reference to FIG. 3, is located against an inner edge 32 of a stud 16. Preferably, four connectors 24 are used with two each spaced apart on the upper 22 and lower 26 edges of the frame 20. Note that the connectors 24 are spaced away from the corners 34 of the frame 20. A lower abutting surface 36 of the connector 24 rests on a side 38 of the stud 16. In this way the connector 24 is mounted inside the frame 20 and does not extend to the outside of the leaf 12, 14. This arrangement is illustrated in FIG. 2(*c*). FIG. 2(*d*) shows insulation 28 which is cut to size, located within the portions of the frame 20, between the battens 18 and studs 16. The insulation 28 has a thickness approximately equal to the width of the studs 16. A suitable insulation may be Frametherm 40 Insulation. Further insulation 32 is positioned over the entire leaf 12, 14, with cut-outs 36 around the connectors 24. This insulation 32 extends to the edges of the frame 20 and can be selected to have a thickness to match the desired cavity wall gap separation. A suitable insulation 32 is Frametherm 35 Insulation. This arrangement is illustrated in FIG. 2(*e*). A second frame 20 is lowered onto the first leaf 12, see FIG. 2(*f*), so that a side 38 rests on an upper abutting surface 42 of the connectors 24 as shown in FIG. 2(*g*). In this way, the frames 20 are held apart at the desired cavity wall gap separation. The insulation 32 is sandwiched between the frames 20. As with the first leaf 12, insulation 28 is located between the studs 16 and battens 18. Additionally, lifting slings 88 are hooked around the connectors 24 on the upper side 22 of the building component 10. This is as illustrated in FIG. 2(*h*). Boarding 44 is located over the second frame 20 to create the second leaf 14, see FIG. 2(*i*). FIG. 2(*j*) illustrates options of a insulation covers in the form of an acoustic wall cap 48 on the upper edge 22 and a lightweight polythene 50 on the other edges. The insulation covers 48, 50 may be affixed to the outer surface of the frames 20 or be attached to the inner surfaces at each side of the cavity gap. The entire arrangement of component 10 provides a single leaf separating wall.

Each part of the building component 10 is nailed to the other parts and provides a cassette structure as a single assembly, which can be manufactured off-site and brought to the construction site as a single component ready for installation. Each component 10 can be lifted into place using the slings 88 and nailed to adjacent building components 10. As the connectors 24 are fixed to the frames 20, the leafs 12, 14 are at a fixed separation to provide a cavity 28 whose width can be checked for quality during manufacture, and thus is guaranteed. Use of the building component 10 speeds up construction time, removes the requirement for metal strips to be used and does not require skilled personnel to maintain the separation between the leafs during construction.

The studs 16, battens 18 and connecting rail(s) 24 can be treated with a water repellent to prevent shrinkage and buckling of the building component and the separating wall in which it forms part of. Additionally, the studs 16, battens 18 and connector 24 can be treated with a fire retardant to improve the fire performance of the structure. If the panels 44 are selected as magnesium oxide wallboards (mgo), then the component can meet the 30 minute fire rating requirements. The component 10 also meets the current standard in Scotland, England and Wales for sound testing. Thermal performance is also met in providing the default U-value of zero.

Referring now to FIG. 3 of the drawings there is illustrated a building connector for a single leaf separating wall, generally indicated by reference numeral 24, according to an embodiment of the present invention. Like parts to those of FIGS. 2(*a*)-(*j*) have been given the same reference numeral to aid clarity. Connector 24 has a substantially rectangular elongate body 60 having first 36 and second 42 opposing ledges on a first surface 62 thereof. The body 60 is made of timber so that it may be treated as for the studs 16, battens 18 and panels 44 as desired. The ledges 36, 42 are arranged perpendicularly to the surface 62 and provide a protrusion 64 having a rectangular front face 66. The protrusion 64 has a length between the ledges 36, 42 equal to a desired separation between two leafs 12, 14 of the separating wall 10. Covering each ledge 36, 42 and the surface 62, there is applied an acoustic attenuation layer 66. The layer 66 is arranged to ensure that all parts of the frame 20 are not in direct contact with the body 60 of the connector 24. In this way there are no passages for sound between the leafs, through the connector 24, which are not obstructed by the acoustic layer 66.

The acoustic layer 66 may be any sound attenuating material. A flexible bitumen based material is preferred as this is easily applied around the connector 24. It should be remembered that the cavity gap separation should include the thickness of the acoustic layer on each ledge 36, 42. Although an acoustic material is suggested, sound attenuation may be achieved by a structure machined on the body 60.

In the embodiment of the connector 24, each end 68 and the surface 62 is chamfered 70. The chamfer 70 is also covered by the acoustic layer 66. Chamfering provides a guide for the second frame 20 to be located on the first leaf 12.

Referring now to FIGS. 4(*a*) to 4(*f*) there is illustrated the building component 10 constructed in a different series of steps. Like parts to those in FIGS. 2(*a*) to (*j*) referenced are given the same reference numerals to aid clarity. In this embodiment the leafs 12, 14 are constructed first. Each leaf 12, 14 has a frame 20 of studs 16 and battens 18. Insulation 28 is located into each leaf 12, 14 before the leafs 12, 14 are brought together on the connectors 24. An intra-cavity insulation layer 32 is also included. In this way, leafs can be manufactured on one site and brought to another site for construction into the single leaf separating wall.

Referring now to FIGS. 5(*a*) and 5(*b*), there is illustrated an assembled building component 10, according to an embodiment of the present invention. Component 10 is representative of the single leaf separating wall as it would be delivered on-site. Component 10 is a single cassette or unit being a sandwiched arrangement with outer panels 44 on timber stud 16 frames 20. Between the frames are arranged an acoustic wall cap material 48 on an upper side 22 at least. On the remaining sides is lightweight polythene 50. The acoustic wall cap 48 is a strip of material which is bitumen based providing acoustic isolation between the frames 20 across the cavity 28. The cap 48 is split 86 at the positions of the connectors 24 (not seen) to allow the lifting slings 88 to protrude through the wall cap 48. When lifted by the slings 88 and located in position on the build, the slings 88 can be cut and removed by pulling through the split 86. Each component 10 can be abutted to another component to provide an extended separating wall, connecting at the upper, lower or side edges of the frames 20. As the connectors 24 are on the inside of the frames 20, there are no pieces sticking out from the component which could prevent close abutment of neighbouring components.

Reference is now made to FIG. 6 of the drawings which illustrates the building component, illustrated by reference numeral 10, in use for a separating wall. Like parts to those of the earlier Figures have been given the same reference numerals to aid clarity. With the component 10 located to provide two separated leafs 12, 14 with a cavity 28 therebetween, a rail 90 is located over each leaf 12, 14. Separate rails 90 on each leaf 12, 14 prevents the transmission of sound across the cavity 28, while the acoustic layer 66 in each connector 24, prevents the transmission of sound between the joists 92 of the floor 94 and the building component 10. The joists 92 are positioned over the leafs 12, 14 and the floor 54 is located as two separated sections on the joists 92. In the cavity 56 created between the joists 92 and the connectors 24, 24*a* insulation can be inserted to further improve the sound performance. A further rail 90*a* is located on the floor 94 and a second building connector 10*a* is positioned thereupon to continue the separating wall. Connection between the component 10*a*, rail 90*a*, floor 94 and joists 92 is achieved by nails driven or hammered in when the building component 310*a* is in place. A ceiling 96 can be located on the underside of the joists 92. It can be readily noted that construction is greatly speeded up by use of a single separating wall 10 as compared to the construction of dual separating walls according to the prior art of FIG. 1.

The fixed separation on the component 10 also assists in construction of the floors 94 and higher separating walls by preventing creep and drifting in construction.

Though not illustrated, it will be appreciated that the component 10 could be used at an outside masonry wall.

The principle advantage of the present invention is that it provides a building component for use as a single leaf separating wall which is a single piece for ease of installation and speed of construction.

A further advantage of the present invention is that it provides a building component for use as a separating wall which provides a guaranteed separation between the leafs without the use of metal strips or other fixings on the outer edges of the leafs.

It will be apparent to those skilled in the art that various modifications may be made to the invention herein described without departing from the scope thereof. For example, attenuation means may be incorporated in the studs and/or battens to further improve sound performance. Insulation need not be incorporated in the component if it is not required. Equally other forms of insulation such as foams can be used in the component. Though it is stated that the component can be manufactured off-site, the component may also be fabricated on-site. While the studs and rails are shown as being connected by nails, engineered joints may be used instead to further improve the sound performance while providing a building component which is entirely made of environmentally friendly sustainable materials.

The invention claimed is:

1. An acoustic attenuated building assembly for use as a separating wall, the assembly comprising a first plurality of timber studs arranged as a first timber frame for a first leaf to provide a perimeter to the assembly, a second plurality of timber studs arranged as a second timber frame for a second leaf matching the perimeter in the assembly, the first and second timber frames being spaced apart with a plurality of acoustic connectors located between the frames, the plurality of acoustic connectors being arranged on an inner edge of the timber studs within the perimeter of the assembly, wherein at least two of the acoustic connectors are arranged on a first side of the assembly, said assembly further comprising an acoustic wall cap disposed across and covering said space between the first and second timber frames on at least one side thereof, the acoustic wall cap being split at the positions of the at least two acoustic connectors to allow lifting straps looped around the at least two acoustic connectors to protrude through the wall cap to lift the assembly into a building construction to abut a further assembly.

2. An acoustic attenuated building assembly according to claim 1 wherein there is at least one connector on a second side, opposite the first side, of the assembly.

3. An acoustic attenuated building assembly according to claim 1 wherein two of the connectors are spaced apart symmetrically along the first side.

4. An acoustic attenuated building assembly according to claim 1 wherein each timber frame is sheathed by a board.

5. An acoustic attenuated building assembly according to claim 4 wherein the board includes acoustic blocking properties to improve the reduction in sound transmission across the assembly.

6. An acoustic attenuated building assembly according to claim 4 wherein the board is selected from a group comprising: gypsum plasterboard, magnesium oxide wallboard or timber boarding.

7. An acoustic attenuated building assembly according to claim 1 wherein one or more parts of the building component are treated with a water repellent.

8. An acoustic attenuated building assembly according to claim 1 wherein one or more parts of the building component are treated with a fire retardant.

9. An acoustic attenuated building assembly according to claim 1 wherein insulation is located between the studs on each frame.

10. An acoustic attenuated building assembly according to claim 1 wherein insulation is located in the separation between the leafs.

11. An acoustic attenuated building assembly according to claim 1 wherein the acoustic connector provides first and second abutting surfaces separated by a desired separation distance.

12. An acoustic attenuated building assembly according to claim 1 wherein the acoustic connector includes a sound attenuation element.

13. An acoustic attenuated building assembly according to claim 12 wherein the sound attenuation element is an acoustic isolator.

14. An acoustic attenuated building assembly according to claim 12 wherein the sound attenuation element is a dampening material.

15. An acoustic attenuated building assembly according to claim 14 wherein the dampening material is a bitumen-based flexible material.

16. An acoustic attenuated building assembly according to claim 1 wherein the connector has a timber body.

* * * * *